US006283231B1

(12) United States Patent
Coelus

(10) Patent No.: US 6,283,231 B1
(45) Date of Patent: Sep. 4, 2001

(54) SOIL DISPLACING SCREW AUGER AND METHOD FOR MAKING A CONCRETE PILE WITH THIS AUGER

(76) Inventor: Gaspar Jozef Coelus, Astridlaan 53, B-8620 Nieuwpoort (BE)

( * ) Notice: Subject to any disclaimer, the term of this patent is extended or adjusted under 35 U.S.C. 154(b) by 0 days.

(21) Appl. No.: 08/984,471

(22) Filed: Dec. 3, 1997

(30) Foreign Application Priority Data

Dec. 3, 1996 (BE) ..... 09601005

(51) Int. Cl.[7] ..... E21B 10/44

(52) U.S. Cl. ..... 175/323; 175/388; 175/391; 175/22; 405/233; 405/241; 405/242

(58) Field of Search ..... 405/242, 240, 405/241, 233; 175/323, 325.1, 325.5, 388, 391, 394, 22

(56) References Cited

U.S. PATENT DOCUMENTS

| | | | | |
|---|---|---|---|---|
| 4,496,011 | * | 1/1985 | Mazo et al. | 175/19 |
| 4,504,173 | * | 3/1985 | Feklin | 405/240 |
| 5,722,498 | * | 3/1998 | Van Impe et al. | 175/394 |
| 5,875,860 | * | 3/1999 | Coelus | 175/323 |

FOREIGN PATENT DOCUMENTS

| | | | | |
|---|---|---|---|---|
| 0131562 | * | 1/1985 | (EP) | 405/242 |

* cited by examiner

*Primary Examiner*—David Bagnell
*Assistant Examiner*—John Kreck
(74) *Attorney, Agent, or Firm*—David M. Ostfeld

(57) ABSTRACT

Soil-displacing screw auger which contains an auger tube (1); a double displacement body (2) equipped with a hollow shaft (8) fixed to the auger tube (1) and containing an upper part (6) which constitutes a closed screw the radius of which increases towards its lower extremity and a lower part (7) which constitutes a closed screw the radius of which decreases towards its lower extremity, preferably with the same pitch as the upper part (6); a lower tube the diameter of which is smaller than twice the largest radius (R2) of the displacement body and which is situated between the lower part (7) of the displacement body (2) and the lower extremity of the auger; a screw blade (4) welded onto the outer casing of the lower tube, which rotates in the same sense as the lower part (7) of the displacement body (2) and an auger tip (5) connected to the lower extremity of the lower tube, with the special characteristic that the lower tube of the auger is an intermediate tube (3) with an outer diameter (D3) which is smaller than twice the largest radius (R2) of the displacement body (2) but larger than the outer diameter (D1) of the auger tube (1), whereas the auger tip (5) contains a displacement part (16) with a closed screw rotating in the same sense as the screw blade (4) on the intermediate tube (3) and a maximal radius equalling half the diameter (D3) of the intermediate tube (3).

12 Claims, 4 Drawing Sheets

SOIL DISPLACING SCREW AUGER AND METHOD FOR MAKING A CONCRETE PILE WITH THIS AUGER

CROSS-REFERENCE TO RELATED APPLICATIONS

This Application claims priority of Belgium application Ser. No. 09601005, filed Dec. 3, 1996, and is a continuation-in-part of U.S. Pat. No. 5,875,860.

BACKGROUND OF THE INVENTION

1. Field of the Invention

This invention relates to a soil-displacing screw auger which contains an auger tube; a double displacement body equipped with a hollow shaft fixed to the auger tube and containing an uppers part which constitutes a closed screw the radius of which increases spirally towards its lower extremity and a lower part which constitutes a closed screw the radius of which decreases towards its lower extremity, preferably with the same pitch as the upper part; a lower tube the diameter of which is smaller than twice the largest radius of the displacement body and which is situated between the lower part of the displacement body and the lower extremity of the auger; a screw blade welded onto the outer casing of the lower tube, which rotates in the same sense as the lower part of the displacement body; and an auger tip connected to the lower extremity of the lower tube.

This type of auger is used to make concrete piles in the ground, which are used as foundations for buildings if the top soil layers are compressible and normal foundations would lead to an inadmissible settlement.

2. Description of the Related Art

The soil is displaced by the double displacement body, so that pressure release in the soil is avoided during the creation of the pile and a smaller quantity of soil is removed from the borehole.

Once the auger has reached a sufficient depth, concrete is poured into the auger tube and the auger is screwed out of the soil. When screwing out, the auger is rotated in the same sense of rotation as during the screwing in. The tip is a lost tip and stays in the ground.

Such an auger has been described in EP-B-0.228.138 in the name of the applicant. In this auger, the lower tube has the same diameter as the auger tube and in practice, this lower tube is a part of the auger tube which extends both underneath and above the displacement body.

With this auger, only a limited depth in good soil, only one meter, can be reached.

The reason for this is that, when screwing into good soil, the soil will accumulate between the turns of the screw blade and very soon, no more soil will be transported to the surface. The entire underside of the auger then displaces the soil, causing the resistance to the screwing into good soil to become too large very soon.

Given their relatively small diameter, piles must have a very large permissible load and penetrate deeply into heavy ground, which is not possible with this type of auger.

BRIEF SUMMARY OF THE INVENTION

The purpose of the present invention is to create a soil-displacing screw auger which avoids this and other advantages and allows the creation of the piles relatively deep into heavy ground.

According to the invention, this purpose is obtained because of the fact that the lower tube of the auger is an intermediate tube with an outer diameter which is smaller than twice the largest radius of the displacement body but larger than the outer diameter of the auger tube, whereas the auger tip contains a displacement part with a closed screw rotating in the same sense as and preferably with a smaller pitch than the screw blade on the intermediate tube and a maximal radius equalling half the diameter of the intermediate tube.

When screwing in, the displacement of the soil is done in two phases, namely first by the displacement part of the auger tip and then by the displacement body, whereas the screw blade on the intermediate tube transports soil upwards.

The screw blade on the intermediate tube preferably has an outer diameter which approximately equals twice the above-mentioned largest radius of this displacement body.

The pitch of the screw blade on the intermediate tube preferably equals the pitch of the spirals of the two parts of the displacement body.

This auger tip could be equipped with a flap in order to allow the concrete to pass during the screwing out, but one extremity of this auger tip is preferably a detachable close-off tip which will be left in the ground as a lost tip; this close-off tip can be a displacement body itself and be equipped with a closed screw on the outside.

The auger tip can be exchangeable and be connected to the intermediate tube by means of a coupling.

In this case the auger tip can have at its upper extremity, above the displacement part, a cylindrical part the diameter of which corresponds to the diameter of the intermediate tube, and a screw blade can be welded onto this cylindrical part with the same diameter and sense of rotation as the screw blade on the intermediate tube and preferably also with the same pitch.

The intermediate tube obviously has a hollow shaft for the concrete, but this hollow shaft is preferably formed by a part of the auger tube passing through the intermediate tube to the lower displacement part or the close-off tip.

This invention also relates to a method for making a pile in the ground according to which the auger described above is screwed into the ground with a distance per revolution which is larger, in compressible soil, than the pitch of the screw blade and which in heavy ground is still larger than the smaller pitch of the displacement part of the auger tip, after which the auger is screwed out with the same sense of rotation, while concrete is poured in the borehole through the auger tube and an opening in the auger tip, for example by leaving behind its extremity.

BRIEF DESCRIPTION OF SEVERAL VIEWS OF THE DRAWINGS

In order to better demonstrate the characteristics of the invention, an ideal form of construction of a soil-displacing screw auger and a method for making a concrete pile with this auger is described below, by way of nonrestrictive example, in accordance with the invention and with reference to the accompanying drawings, in which:

illustration 1 gives a front view of a soil-displacing screw auger in accordance with the invention;

Figure 1:
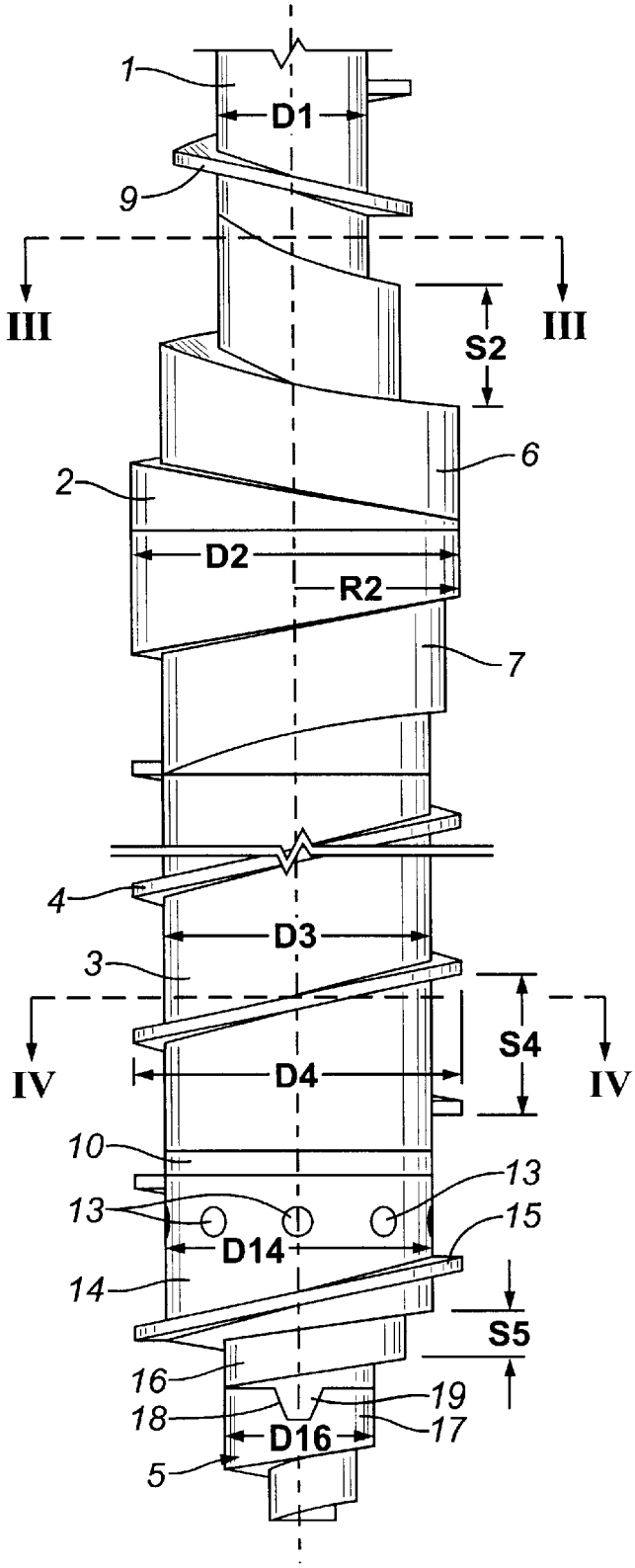
Figure 2:
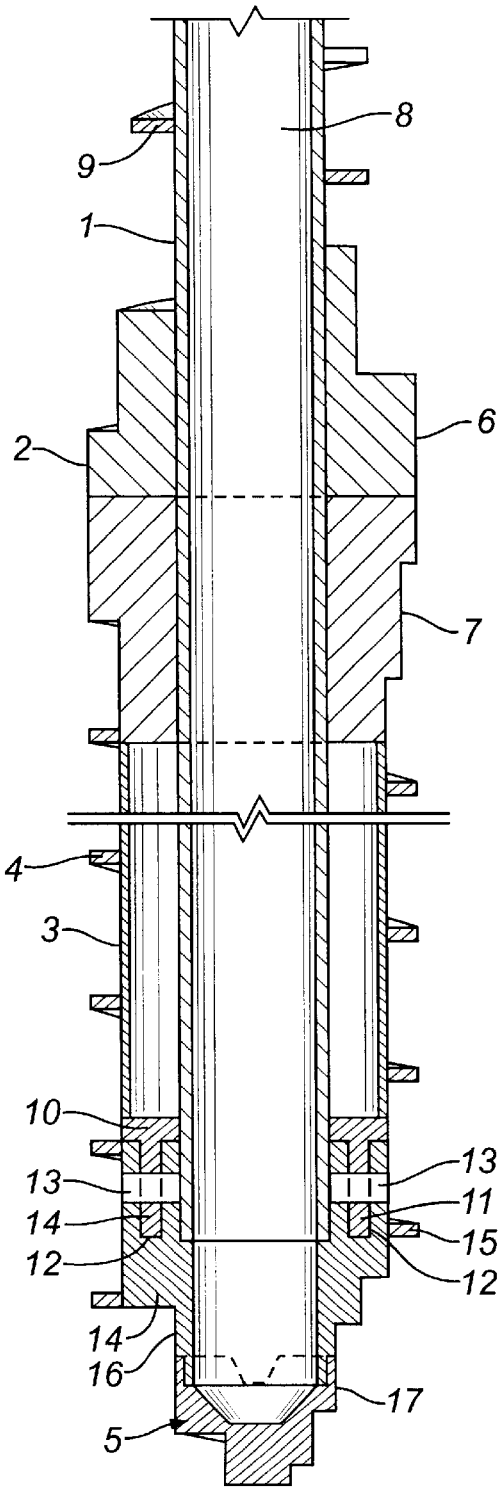
Figure 3:
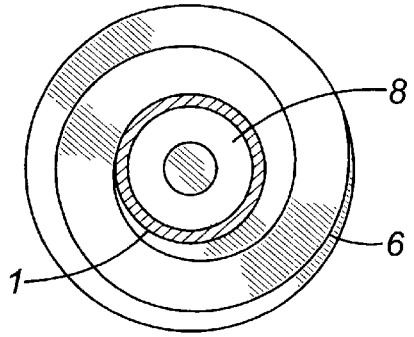
Figure 4:
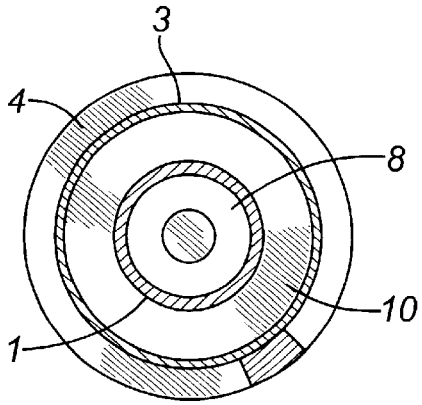
Figure 5:
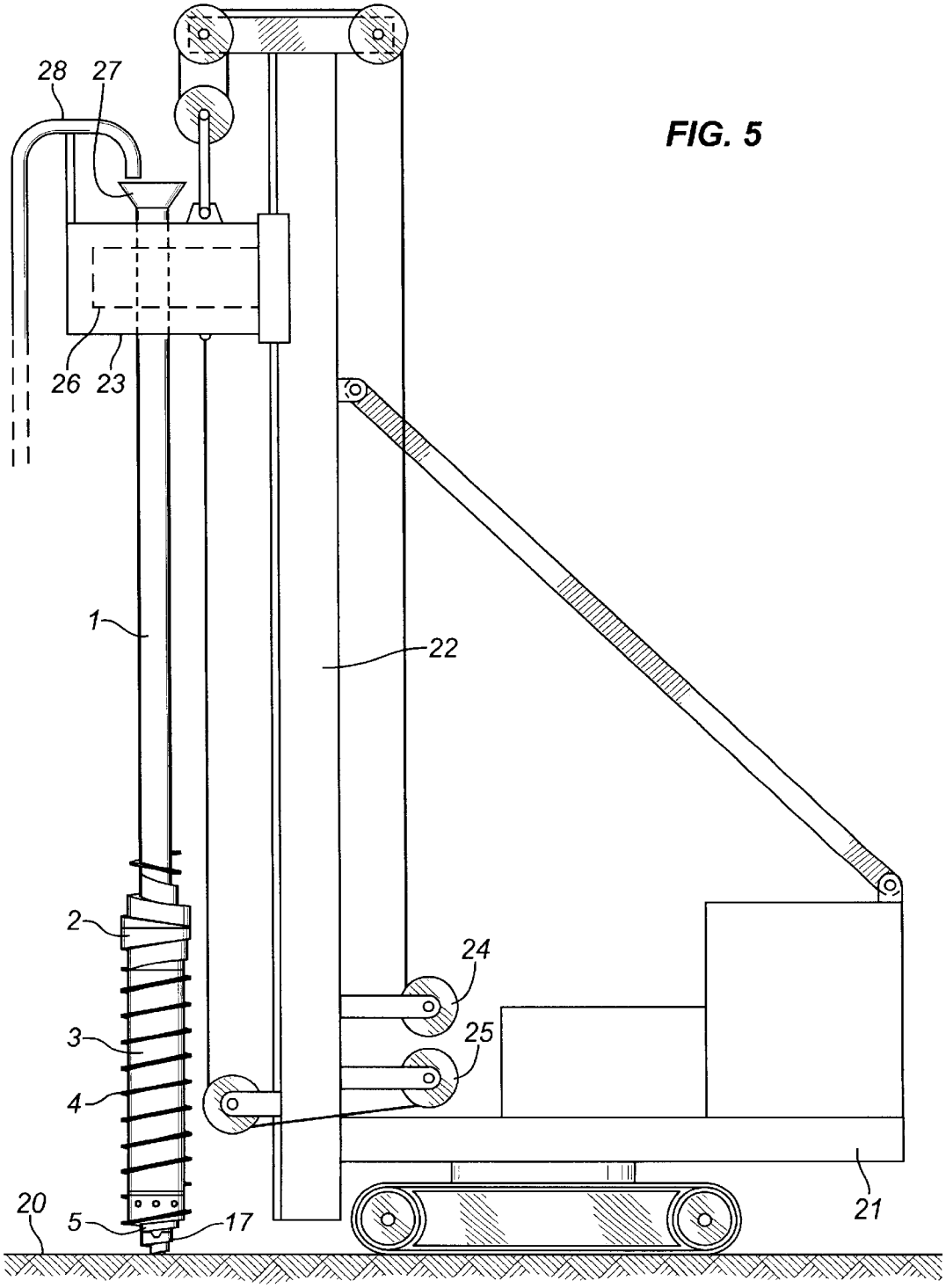
Figure 6:
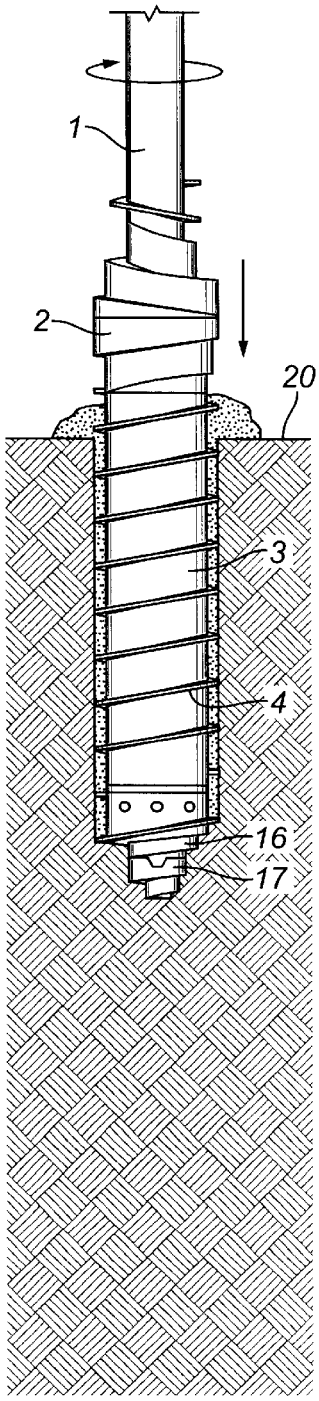
Figure 7:
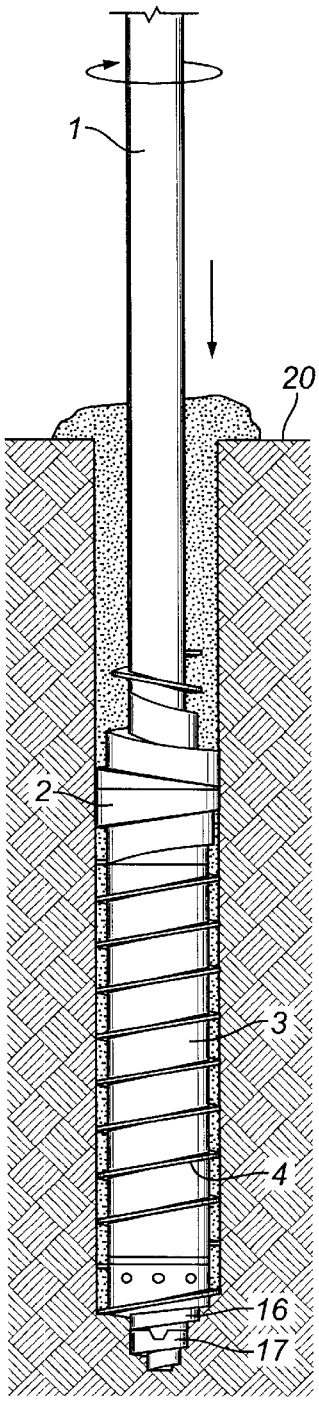
Figure 8:
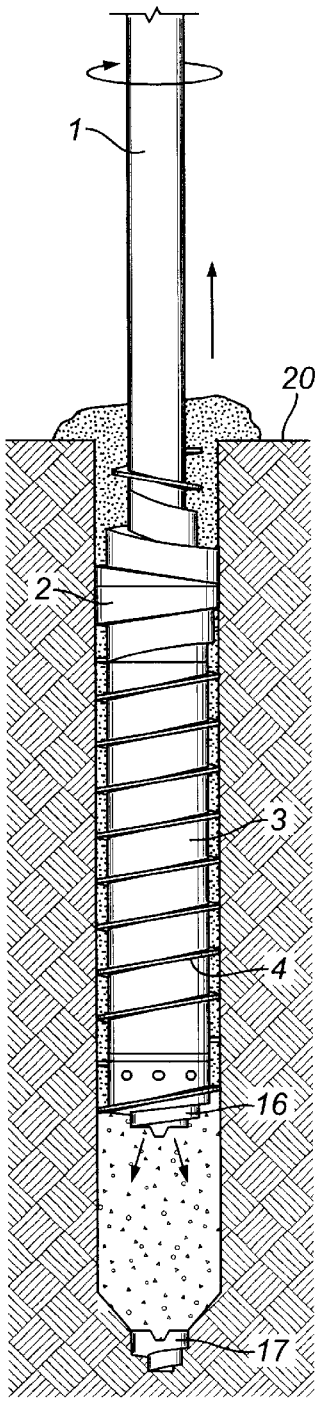

illustration 2 represents a longitudinal section of the screw auger according to illustration 1;

illustrations 3 and 4 represent cross-sections according to the lines III—III and IV—IV respectively in illustration 1;

illustration 5 represents an auger installation containing the screw-displacing screw auger in accordance with the invention;

Illustrations 6, 7 and 8 represent different phases of the method for making a concrete pile with the screw auger, according to illustrations 1 to 4.

DETAILED DESCRIPTION OF THE INVENTION

The soil-displacing screw auger according to illustrations 1 to 4 mainly consists of an auger tube 1, a hollow displacement body 2 at a certain distance from the upper extremity of the auger tube 1, an intermediate tube 3 underneath the displacement body 2, a screw blade 4 on the outer casing of the intermediate tube 3 and an auger tip 5 on the lower extremity of intermediate tube 3.

The displacement body 2 is composed of an upper part 6, the outside of which constitutes a closed screw the radius of which increases spirally from slightly larger than half the outer diameter D1 of the auger tube 1 to a maximum radius R2, and of a lower part 7, the outside of which also constitutes a closed screw but the radius of which decreases spirally towards its lower extremity from the above-mentioned maximum radius R2 to half the outer diameter D3 of the intermediate tube 3.

Both parts 6 and 7 of the displacement body 2 have the same pitch S2.

The displacement body 2 has a hollow shaft 8 for the pouring of the concrete, the diameter of which equals the inner diameter of the auger tube 1. This hollow shaft 8 can be formed by an opening, but in the form of construction represented in the illustrations, the hollow shaft 8 is formed by the inside of the auger tube 1 itself which extends axially through the displacement body 2 and even through the intermediate tube 3 until it reaches the auger tip 5.

The auger tube 1 has a diameter D1, between 0.3 and 0.6 times the diameter of the pile that must be made.

Right on top of the displacement body 2, the outside of auger tube 1 is equipped with a screw blade 9 with only one winding, a pitch equalling pitch S2 of the parts 6 and 7 and an outer diameter which is smaller than the diameter D3 of intermediate tube 3 and approximately equals three quarters of diameter D2; this is twice the above-mentioned maximum radius R2 of the displacement body 2 or, in other words, the diameter of the pile that must be made.

Screw blade 4 on intermediate tube 3 has an outer diameter D4 which equals twice the maximum radius R2 of the displacement body 2, thus equalling D2, and a pitch S4 which equals the pitch S2 of the displacement body 2.

The upper extremity of intermediate tube 3 is welded to the lower part 7 of the displacement body 2, whereas the lower extremity of intermediate tube 3 is connected to auger tube 1 by means of a ring 10.

Onto this ring 10, a downward flange 11 is welded, which fits into a corresponding groove 12 welded onto an upper cylindrical part 14 of auger tip 5.

Pins 13, which protrude radially through the cylindrical part 14 and flange 11, connect auger tip 5 to the intermediate tube 3 in such a way that the auger tip 5 can be detached and replaced.

On the outside of the cylindrical part 14, a screw blade 15 is welded with the same sense of rotation and the same pitch as screw blade 4. The outer diameter of screw blade 15 equals the outer diameter D4 of screw blade 4. This screw blade 15 can be an extension of screw blade 4 and even be fluently connected to screw blade 4.

Next to this top cylindrical part 14, the auger tip 5 also contains a lower displacement part 16 and a close-off tip 17 which also has the shape of a displacement part.

The outer wall of this lower displacement part 16 constitutes a closed screw the radius of which increases spirally towards the top with a pitch S5 until it equals half the diameter D14 of the cylindrical part 14. At the bottom, this screw ends in a cylindrical extremity, with an outer diameter D16 which is somewhat larger than diameter D1 of auger tube 1.

The pitch S5 is smaller than the pitch S4 of the screw blade 4 and the equal pitch S2 of the displacement body 2.

The close-off tip 17 has a closed screw on the outside, the radius of which increases spirally with the same pitch S5 as the displacement part 15 from a minimum to half the above-mentioned outer diameter D16.

At the top, the screw of close-off tip 17 ends in a cylindrical part with the above-mentioned diameter D16, which is provided with trapezial notches 18 matching the teeth 19 on the cylindrical lower extremity of the above-mentioned displacement part 16.

In order to make a concrete pile in the ground, the auger described above is screwed into the ground 20 by means of an auger installation represented in illustration 5.

This auger installation contains a mobile undercarriage 21 with a mast 22 mounted in such a way that it can be tilted down and placed vertically during the boring. The undercarriage 21 can be supported or anchored during the screwing.

A drilling table 23 can be slid over the mast 22 by means of two winch mechanisms, namely a winch mechanism 24 to pull the drilling table 23 up and a winch mechanism 25 to push this drilling table 23 down.

In or on the drilling table 23, a swivel gear 26 with a hollow shaft is mounted, to which the auger tube 1 is be connected during the screwing, in order to rotate it and to move it up or down with the drilling table 23.

On top of the drilling table 23, onto the above-mentioned hollow shaft, a funnel 27 is mounted which ends into auger tube 1. By means of a concrete pump, concrete can be pumped into funnel 27 through a pipe 28 in order to fill auger tube 1.

As represented in illustration 5, the auger, with the close-off tip 17, is placed on the ground 20 and is rotated by the drilling table 23 and pulled down at the same time by winch mechanism 25.

When the auger is pulled into the ground 20, while rotating, the close-off tip 17 closes off auger tip 5 and thus also the lower opening of auger tube 1, so that soil and water are prevented from penetrating into auger tube 1.

The teeth 19 pull this close-off tip 17 into the ground.

In the top layers, which are easily compressible, the auger is pulled into the ground with a distance per revolution which is larger than pitch S5 of the displacement part 16 and of the close-off tip 17.

This phase is represented in illustration 6.

As soon as the auger reaches heavier ground, as represented in illustration 7, this distance per rotation decreases, but stays larger than the pitch S5.

The tensile force of the winch mechanism 25 is added to the tensile force of screw blade 4, which increases as the slip of the soil between the windings increases and the soil becomes more solid. This slip equals the difference between pitch S4 of this screw blade and the above-mentioned distance per revolution.

The auger tip 5 displaces the soil until diameter D3 of the intermediate tube 3 is reached.

In order for the auger to remain displacing, the volume of soil displaced laterally by auger tip 5 must at least equal the volume of soil transported upwards by screw blades 15 and 4.

With a minimal sinking of the auger (S5 per revolution), the volume of soil displaced per revolution by the auger tip 5 equals:

$$3.14\times D3^2\times S5/4=3.14\times(D4^2-D3^2)\times(S4-S5)/4$$

The quantity of soil transported is:

$$3.14\times(D4^2-D3^2)\times(S4-S5-A)/4$$

in which A=a×S5/S4 with a=the thickness of screw blades 15 and 4.

This means that over the entire length of the intermediate tube 3, only the quantity of soil situated in the space taken up by screw blade 4 is actually displaced, which is a very small quantity. The displacement is only sufficient to prevent pressure release in the soil.

Screw blades 15 and 4 transport most of the soil situated between the windings upwards, to the displacement body 2, where this soil is displaced by the lower part 7 until the diameter D4 or twice the radius R2, which corresponds to the diameter of the pile that must be made, is reached.

The dimensions of the auger are chosen in such a way that $$S2=S4=S5\times D4^2/(D4^2-D3^2)$$

D4 corresponds to the diameter of the pile that must be made. The pitch S5 of the displacement part 16 and the close-off tip 17 is preferably not too large, between 5 and 7.5 cm. The diameter D3 of the intermediate tube 3 is preferably chosen in such a way that $D2^2/1.7<D3^2<D2^2/1.35$. Experience has shown that it can be assumed that D3=0.816×D4.

For augers with a diameter D4 of the screw blade 4, and consequently for piles with the same diameter, between 410 and 560 mm, for instance, an auger tube 1 with an outer diameter D1 of 267 mm and an inner diameter of 217 mm is used. For augers with a diameter D4 between 560 and 710 mm, for instance, an auger tube with an outer diameter D1 of 324 mm and an inner diameter of 276 mm is used.

The auger remains soil-displacing, but does penetrate into the ground 20 with a minimal consumption of energy.

Because of the pressure needed for the displacement underneath part 7, no pressure release of the soil underneath this part 7 is possible. This pressure is considerably lower than the pressure at the auger tip 5, which is also a reason for the low energy consumption.

Obviously, the auger tube 1 has to have a sufficient length in order to allow the auger to penetrate into the soil until it reaches the required depth which can be deduced from a preliminary soil analysis. This auger tube 1 can consist of a certain number of components which are connected to each other. The number of components depends in this depth.

When the auger has reached the required depth, concrete is pumped into funnel 27 and consequently into auger tube 1.

Instead of winch mechanism 25, winch mechanism 24 is now used and the drilling table 23 with the auger is pulled upwards, while the auger is still rotated in the same sense by the swivel gear 26.

When the auger is pulled up, the close-off tip 17 is left behind because of the adhesiveness of the soil and the pressure of the concrete, so that the concrete can flow into the space underneath the auger, as represented in illustration 8.

The pressure in the concrete is larger than the earth pressure, so that the soil cannot be relieved of pressure.

Because the auger keeps rotating in the same sense, the soil must be trapped between the windings of the screw blade 4, so that the space underneath the auger, which is moving upwards, is a cylinder with a diameter D4 or 2×R2.

The screw blade 9 and especially the upper part 6 of the displacement body 2 displace the soil which fell against the auger tube 1 on top of the displacement body 2 during the screwing out, until diameter D4 is reached. No soil is pressed out of the boring hole, so that no soil or silt must be removed from the building site.

If a sufficient quantity of concrete is pumped into auger tube 1, a cylinder made of concrete with diameter D4 will be obtained, with a length that is sufficient to ensure the bearing capacity determined by the soil analysis.

Not only the length of auger tube 1 must be adjusted: the length of the part of the auger situated underneath the displacement body 2 can also be adjusted, depending on the results of the soil analysis, for instance by inserting an extension piece of intermediate tube 3 between auger tube 1 and auger tip 5.

This extension piece has a screw blade on its outside casing, which has the same pitch and the same dimensions as screw blade 4, to which it is preferably connected, a groove 12 on one extremity, into which flange 11 is attached by means of the pins 13, and a flange 11 at the other extremity, which is attached to the groove 12 of auger tip 5 by means of such pins.

A longer part between the displacement body 2 and the auger tip 5 helps to connect the solid layers with layers of weak soil in between them to each other by improving the quality of the soil of these weak layers. In each weak layer, the auger sinks with more than pitch S5 of auger tip 5.

The coupling created by flange 11, groove 12 and pins 13 does not only allow the insertion of the above-mentioned extension piece, but also allows easy replacement of the non-lost part of auger tip 5, which consists of cylindrical part 14, screw blade 15 and displacement part 16, which is most liable to wear and tear.

The auger allows to easily screw into heavy ground until the required depth is reached and thus to make a pile with a large bearing capacity.

This invention is by no means restricted to the forms of construction described above and represented in the illustrations, but such a screw auger and the method for making a pile with this auger can be used in different variants without falling outside the framework of the invention.

What is claimed is:

1. In a Soil-displacing screw auger which contains an auger tube (1); a double displacement body (2) equipped with a hollow shaft (8) fixed to the auger tube (1) and containing an upper part (6) which constitutes a closed screw the radius of which increases spirally towards the lower extremity and a lower part (7) which constitutes a closed screw the radius of which decreases spirally towards its lower extremity, with substantially the same pitch as the upper part (6); a lower tube, the diameter of which is smaller than twice the largest radius (R2) of the displacement body (2) and which is situated between the lower part (7) of the displacement body (2) and the lower extremity of the auger; a screw blade (4) welded onto the outer casing of the lower tube, which rotates in the same sense as the lower part (7) of the displacement body (2) and an auger tip (5) connected to the lower extremity of the lower tube, the improvement comprising: the lower tube of the auger is an intermediate tube (3) with an outer diameter (D3) which is smaller than twice the largest radius (R2) of the displacement body (2) but larger than the outer diameter (D1) of the auger tube (1), whereas the auger tip (5) contains a displacement part (16) with a closed screw rotating in the same sense as the screw blade (4) on the intermediate tube (3) and a maximal radius equalling half the diameter (D3) of the intermediate tube (3).

2. Screw auger in accordance with claim 1, with the special characteristic that the screw blade (4) has an outer diameter (D2) which substantially equals twice the above-mentioned largest radius (R2) of the displacement body (2).

3. Screw auger in accordance with claim 2, with the special characteristic that the closed spiral of the displacement part (16) of the auger tip (5) has a smaller pitch (S5) than pitch (S4) of the screw blade (4) on the intermediate tube (3).

4. Screw auger in accordance with claim 3, with the special characteristic that the pitch (S4) of screw blade (4) on intermediate tube (3) equals the pitch (S2) of the screws of the two parts (6 and 7) of the displacement body (2).

5. Screw auger in accordance with claim 4, with the special characteristic that the pitch (S2) of the displacement body (2) and the pitch (S4) of screw blade (4) on the intermediate tube (3) are equal and to $S5 \times D4^2/(D4^2-D3^2)$, in which S5 is the pitch of the displacement part (16) of auger tip (5), D4 is the outer diameter of the above-mentioned screw blade (4) and D3 is the outer diameter of intermediate tube (3).

6. Screw auger in accordance with claim 5, with the special characteristic that one extremity of the auger tip (5) is a detachable close-off tip (17) which will be left behind in the ground (20) as a lost tip.

7. Screw auger in accordance with claim 6, with the special characteristic that this close-off tip (17) is a displacement body itself and has a closed screw on the outside with the same pitch as the displacement part (16) of the auger tip (5) and with a radius which increases towards this displacement part (16).

8. Screw auger in accordance with claim 7, with the special characteristic that the auger tip (5) can be exchanged and is connected to the intermediate tube (3) by means of a coupling.

9. Screw auger in accordance with claim 8, with the special characteristics that the auger tip (5) has a cylindrical part at the top, above the displacement part (16), the diameter (D14) of which corresponds to the diameter (D3) of the intermediate tube (3) and a screw blade (15) on this cylindrical part (14) with the same diameter and sense of rotation as screw blade (4) on intermediate tube (3) and preferably with the same pitch.

10. Screw auger in accordance with claim 9, with the special characteristic that the intermediate tube (3) has a hollow shaft (8) for the concrete, formed by part of the auger tube (1) extending through the intermediate tube (3) until or into the displacement part (16) of auger tip (5).

11. Screw auger in accordance with claim 10, with the special characteristic that the pitch (S5) of the displacement part (16) of the auger tip (5) has a value between 5 and 7.5 cm.

12. Screw auger in accordance with claim 11, with the special characteristic that the outer diameter (D3) of the auger tube (3) has a value between D2/1.3 and D2/1.17, in which D2 is twice the maximum radius R2 of the displacement body (2).

* * * * *